United States Patent [19]

Fujimoto

[11] 4,059,262

[45] Nov. 22, 1977

[54] SHEET DELIVERY APPARATUS

[75] Inventor: Sakae Fujimoto, Chofu, Japan

[73] Assignee: Ricoh Co., Ltd., Tokyo, Japan

[21] Appl. No.: 717,671

[22] Filed: Aug. 25, 1976

[30] Foreign Application Priority Data

Aug. 25, 1975 Japan ..... 50-102684

[51] Int. Cl.[2] ..... B65H 3/04; B65H 3/06; B65H 3/52

[52] U.S. Cl. ..... 271/35; 271/37; 271/124; 271/125; 271/160

[58] Field of Search ..... 271/35, 124, 125, 121, 271/37, 165, 167, 122, 160

[56] References Cited

U.S. PATENT DOCUMENTS

| | | | |
|---|---|---|---|
| 1,169,352 | 1/1916 | Rees et al. | 271/35 UX |
| 1,279,311 | 9/1918 | Feybusch | 271/35 X |
| 3,322,602 | 5/1967 | Schneider | 271/35 X |
| 3,984,095 | 10/1976 | Zimmer | 271/35 X |

*Primary Examiner*—Bruce H. Stoner, Jr.
*Attorney, Agent, or Firm*—Cooper, Dunham, Clark, Griffin & Moran

[57] ABSTRACT

A sheet delivery apparatus includes a sheet delivering revolving member in abutting relationship with a sheet separating member, which members cooperate to deliver the lowermost one of sheets in a stack through a nip therebetween while maintaining the forward edge face of the sheets in an inclined position.

6 Claims, 15 Drawing Figures

SHEET DELIVERY APPARATUS

BACKGROUND OF THE INVENTION

The invention relates to a sheet delivery apparatus adapted for use in facsimile systems, copying machines, duplicating machines or the like.

Copying and duplicating machines employ a stack of sheets cut to size, which are sequentially fed one by one while using an apparatus such as a corner separator to avoid a double sheet delivery. However, to ensure a delivery of separated sheets by the use of the corner separator, the sheets delivered must be of a uniform or substantially uniform quality. While this does not present a serious problem in copying machines where the sheet material used is limited to a certain class of paper qualities, facsimile systems involve the feeding of originals of widely varying qualities.

Heretofore it has been almost impossible to assure in a complete manner a separate delivery of sheets of varying paper quality one by one from a stack thereof. In particular, originals used in facsimile systems frequently vary in quality, and it has been impossible for the originals of varying paper quality to be automatically fed to a scanning station when they are placed in a stack. This has necessitated the limitation of paper quality for originals, the use of a sheet carrier of a transparent sheet material which holds an original sandwiched therein, or a manual supply of originals into the scanning station.

SUMMARY OF THE INVENTION

It is an object of the present invention to provide a sheet delivery apparatus capable of reliably delivering sheets one by one from a stack thereof even when they are of a varying paper quality or creased.

In accordance with the invention, the sheet delivery apparatus essentially comprises a sheet delivering revolving member on which is placed the leading end portion of sheets disposed in a stack, a sheet separating member which is disposed in abutting relationship with the revolving member, and drive means for the revolving member. The sheet separating member may be in the form of a plate or a non-rotating stationary roller which bears against a forward edge face of the sheets in the stack which is shaped into a nearly cusp configuration with a pointed end in coincidence with the forward end of the lowermost sheet. As the sheet delivering revolving member is set in motion in a direction to deliver a sheet, the lowermost sheet in the stack is fed forward by friction with the revolving member while passing through the nip between the two members. To this end, the surface of the revolving member has a coefficient of friction with the sheets which exceeds the coefficient of friction between the sheets.

In an experiment conducted by using a stack of sheets of varying paper quality including a tissue paper and arranged in a random order, the apparatus of the invention successfully separated all of the sheets in a reliable manner.

DESCRIPTION OF PREFERRED EMBODIMENTS

Figure 1:
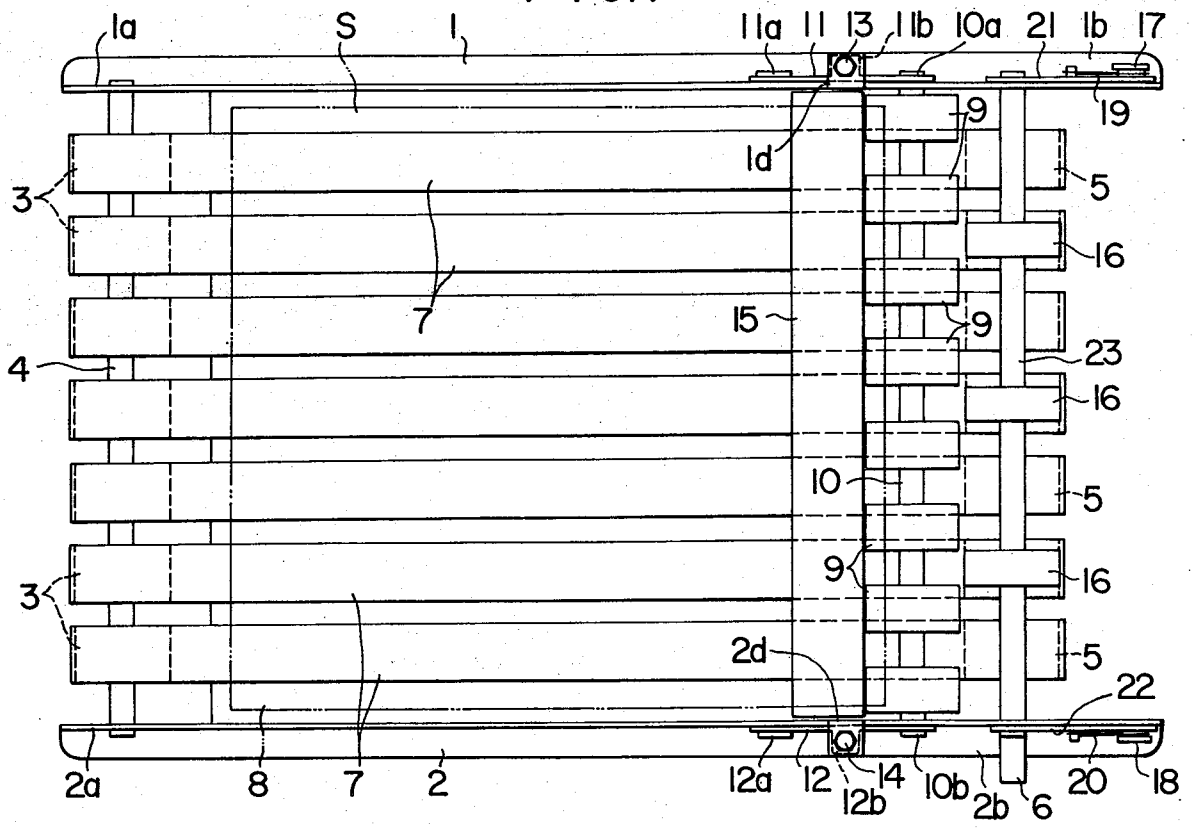
FIG. 1 is a plan view of a sheet delivery apparatus constructed in accordance with one embodiment of the invention.

Referring to FIG. 1, there are shown a pair of stationary sideplates 1, 2 disposed in parallel relationship.

A plurality of belt roller segments 3 are fixedly mounted on a driven shaft 4 which is rotatably mounted on the rear ends 1*a*, 2*a*, or the left-hand ends as viewed in FIG. 1, of the sideplates 1, 2. A plurality of belt roller segments 5 are fixedly mounted on a belt drive shaft 6 which is rotatably mounted on the front ends 1*b*, 2*b*, of the sideplates 1, 2 and which is driven for rotation in a direction indicated by an arrow *a* (see FIG. 2). A plurality of endless belts 7 which collectively represent a sheet delivering revolving member extend around the roller segments 3 and 5. The upper run of the endless belts 7 has its lower surface in bearing contact with the top surface of a belt support plate 8 which is secured to the sideplates 1, 2 along its opposite lateral edges (see FIG. 2).

Figure 3:
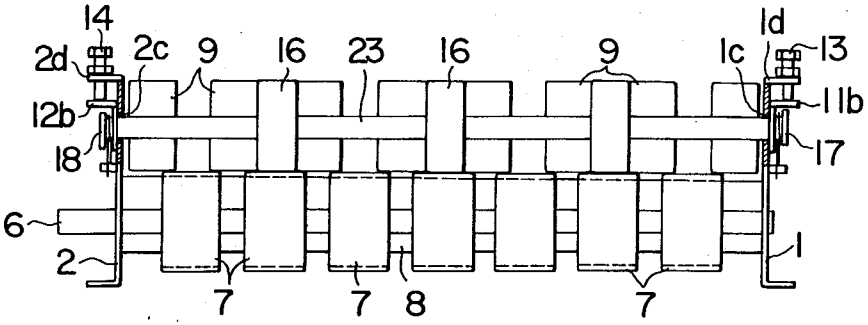
FIG. 3 is a schematic front view of the apparatus, as viewed from the right-hand end of FIG. 1.

A plurality of separator rollers 9 which collectively represent a sheet separating member are located above the forward end 8*a* of the plate 8. Specifically, these rollers 9 are fixedly mounted on a support shaft 10 having its opposite ends 10*a*, 10*b* extending through openings 1*c*, 2*c* (see FIG. 3) formed in the sideplates 1, 2. The opposite ends 10*a*, 10*b* of the support shaft 10 are carried by the free ends of a pair of support arms 11, 12 which are pivotally mounted on a pair of stub shafts 11*a*, 12*a* secured to the sideplates 1, 2. In this manner, the support shaft 10 is assured against free rotation. The arms 11, 12 are centrally formed with laterally extending ears 11*b*, 12*b*, respectively, against which bear the free ends of screws 13, 14 which in turn threadably engage lateral extensions 1*d*, 2*d* from the sideplates 1, 2 (see FIG. 3). By adjusting these screws 13, 14, the arms 11, 12 can be rotated about the stub shafts 11*a*, 12*a* so as to maintain the separator rollers 9 in abutting relationship with the endless belts 7, which run over the belt support plate 8.

Figure 6:
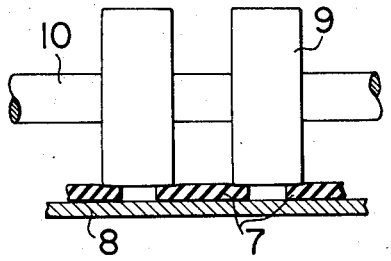
FIG. 6 is a fragmentary front view, partly in section, showing the abutting relationship between a belt-shaped revolving member and a roller-shaped separating member.

As shown in FIG. 6, each of the separator rollers 9 has a width and spacing such that it spans the space between and bears against a pair of immediately adjacent endless belts 7 only at their edge portions. It is to be noted that the rollers 9 themselves do not rotate. The materials for the belts 7 and the separator rollers 9 are chosen with respect to each other and the materials of the sheets to be delivered such that the belts 7 have a coefficient of friction $\mu$ with respect to the sheets which is greater than the coefficient of friction $\mu 1$ of the separator rollers 9 with respect to the sheets, which is in turn greater than the coefficient of friction $\mu 2$ between the sheets.

A stack of sheets S is placed on the endless belts 7, for which the plate 8 provides a mechanical support. Adjacent to the forward end of the stack, a sheet retaining member 15 is placed on top of the stack so as to provide a uniform weight across the width of the sheets to prevent the sheets from becoming loose.

A plurality of sheet guide rollers 16 are located above selected belt roller segments 5 in vertical alignment therewith. These rollers 16 are fixedly mounted on a shaft 23 carried by the free ends of a pair of support arms 21, 22 which are in turn pivotally mounted on stub shafts 17, 18 secured to the sideplates 1, 2 and which are biased by a pair of springs 19, 20 to urge the rollers 16 into abutting relationship with the endless belts 7. However, since the purpose of the rollers 16 is to guide a sheet as it is delivered, it is unnecessary to associate an individual roller with each belt, but alternate belts may be associated with these rollers, as shown.

Figure 2:
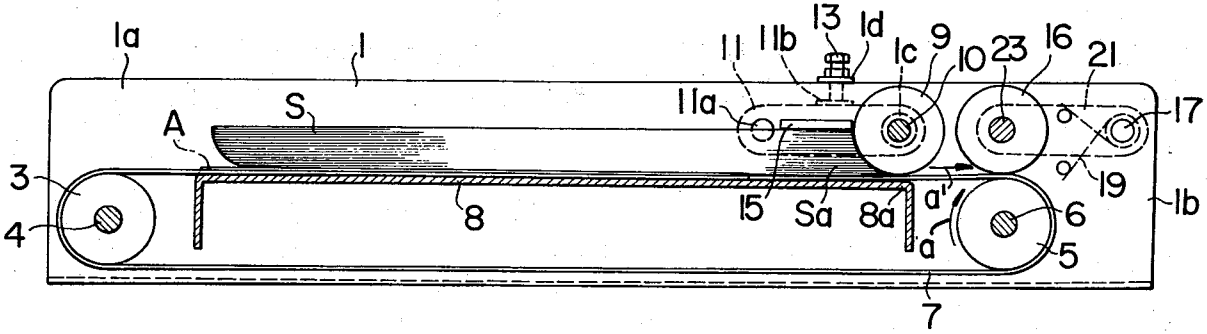
FIG. 2 is a side elevation partly in section of the embodiment shown in FIG. 1.

As shown in FIG. 2, the sheets S are loaded in the manner shown so that their forward edge face is in a cusp configuration extending into the clearance between the periphery of the separator rollers 9 and the surface of the belts 7. This can be achieved by bringing the front end of individual sheets into abutment against the periphery of the separator rollers 9 as the sheets are placed on the belts. Alternately, a stack of sheets may be simply placed on the belts 7 with their right-hand or forward edges in vertical registry, and as the belts 7 are set in motion, the sheets S in the stack will shift in the direction of movement of the belts to a varying degree such that their forward edges Sa conform to the periphery of the rollers 9. In this manner, the forward edge of the lowermost sheet in the stack will assume the most advanced position.

In operation, when drive means, not shown, is energized in response to a sheet delivery command, the drive shaft 6 is set in motion to drive the belts 7 in a direction indicated by an arrow $a'$ in FIG. 2. Thereupon, the sheets S of the stack tend to move in a body in the same direction, but their movement is immediately blocked by abutment against the periphery of the non-rotating separator rollers 9. However, the lowermost sheet S1 (FIG. 4) which is in contact with the belts 7 is fed forward by the latter because of the greater coefficient of friction $\mu$ between it and the belts than the coefficient of friction $\mu 2$ between it and the other sheets.

Figure 4:
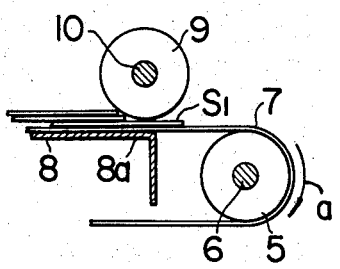
FIGS. 4 and 5 are fragmentary side elevations, partly in section, of the apparatus, illustrating the function thereof as one sheet is separated from an adjacent sheet.
Figure 5:
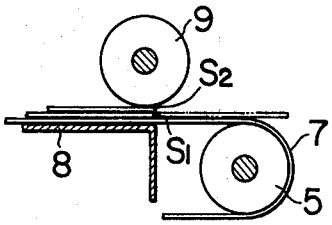

As the leading end of the lowermost sheet S1 is brought into the nip between the separator rollers 9 and the belts 7, the sheet S1 continues to be fed by the latter because of the greater coefficient of friction $\mu$ between it and the belts than the coefficient of friction $\mu 1$ between it and the separator rollers 9 (see FIG. 4). If a double sheet feeding occurs as illustrated by lowermost sheets S1 and S2 shown in FIG. 5, the relative magnitude of the coefficients of friction of the belts 7, separator rollers 9 and sheets as represented by the inequality $\mu > \mu 1 > \mu 2$ causes the separator rollers 9 to interrupt a continued forward movement of the next lowermost sheet S2 while allowing the lowermost sheet S1 to be conveyed by the belts 7. Any tendency of the leading end of the sheet or sheets to buckle as they enter the separator station is suppressed by the action of the sheet retaining member 15.

It will be noted that as the lowermost sheet is delivered, the sheet which is located directly above it will come into contact with the belts 7 and will be fed thereby while maintaining its abutment against the separator rollers 9 before the delivery of the preceding sheet is completed. To avoid this difficulty, a spacer A is interposed between the stack and the belts to limit the area of contact of the belts to a region corresponding to the forward end portion of the lowermost sheet in the stack. The spacer A is formed of a low friction material having a coefficient of friction less than that of the sheets.

The described apparatus provides a positive and reliable sheet separation despite the varying paper quality, allowing disregard of the rigidity which is required of sheets in an arrangement utilizing a corner separator. Since the delivery takes place in a sequential manner starting with the lowermost sheet, originals to be transmitted in a facsimile system may simply be stacked one above another, without requiring a momentary stop of the system as in the prior art practice for loading an original. Thus the operational efficiency of the system is improved. The division of the sheet delivery revolving member into a plurality of endless belts spaced from each other and each of which is engaged on its upper surface at both its edges by the separator rollers, prevents a belt chasing and achieves a uniform distribution of abutting pressures, thus effectively preventing a skewed running of the sheet.

Though the separator rollers 9 must not rotate for their effectiveness, they may periodically act as the sheet separating member for the convenience of changing the surface area used, by rotating them periodically, inasmuch as they are subject to abrasion by sliding contact with the sheet being conveyed or the belts. However, it should be understood that the sheet separating member need not be limited to a roller or rollers provided the problem of abrasion is suitably solved.

Figure 7:
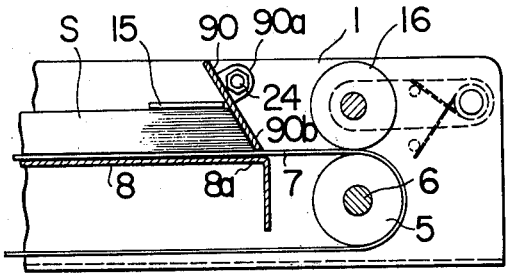
FIG. 7 is an elevational section of another embodiment of the sheet delivery apparatus of the invention.
Figure 8:
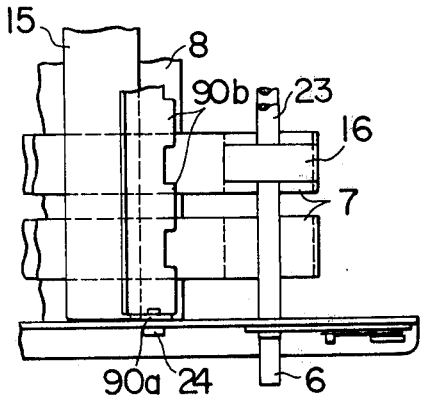
FIG. 8 is a fragmentary top view of the apparatus shown in FIG. 7.
Figure 9:
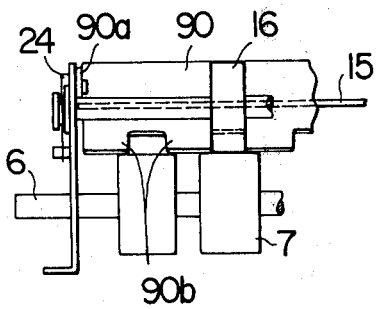
FIG. 9 is a fragmentary front view of the apparatus shown in FIG. 7.

FIGS. 7 to 9 show another embodiment in which a plate member is substituted for the separator rollers 9. Parts corresponding to those appearing in FIGS. 1 to 6 are designated by like numerals and will not be described. A sheet separator plate 90 is disposed above the forward end 8*a* of the belt support plate 8 which again mechanically supports the endless belts 7. The plate 90 is provided with ears 90*a* on its opposite ends (only one being shown), which are rockably connected with the sideplates 1, 2 by means of screws 24. The lower edge of the plate 90 is uneven and has spaced projections 90*b*, which are placed in contact with the lateral edges of individual belts 7, whereupon the screws 24 are tightened to fix the plate 90 in position. As shown in FIG. 7, the plate 90 assumes an inclined position such that the sheets S in the stack disposed on the belts 7 have their forward edge successively advanced relative to the immediately upper sheets. As mentioned above in connection with the embodiment shown in FIGS. 1 to 6, the present embodiment delivers only the lowermost sheet when the endless belts 7 are set in motion in response to a sheet delivery command. The engagement of the individual projections 90*b* with the respective upper surfaces at their opposing lateral edges of immediately adjacent belts 7 again prevents a belt chasing.

Figure 12:
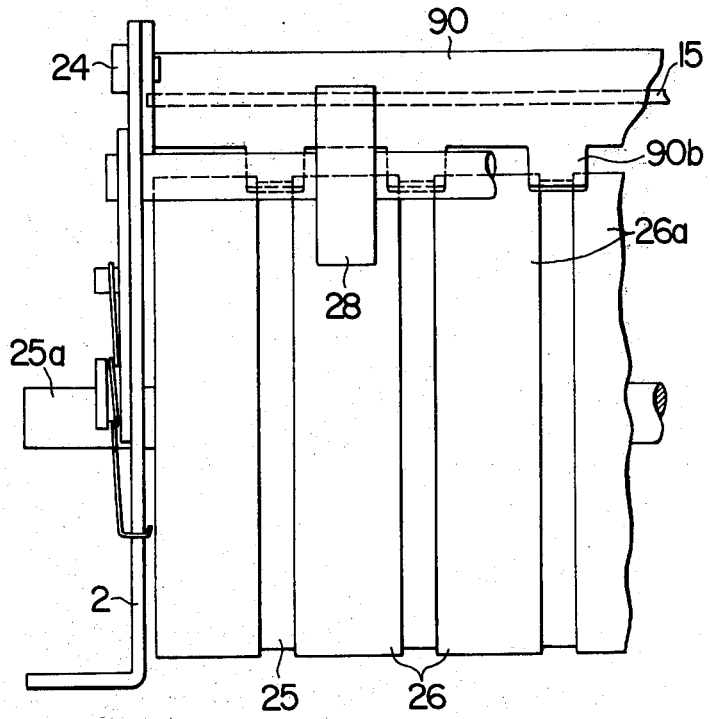
FIG. 12 is a fragmentary front view of the apparatus shown in FIG. 10.
Figure 10:
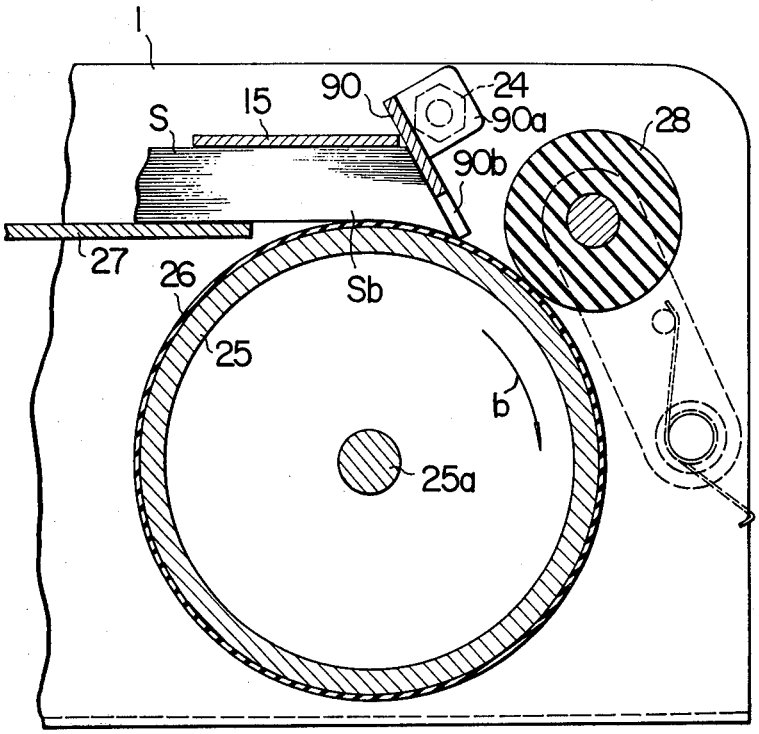
FIG. 10 is an elevational section of a further embodiment of the sheet delivery apparatus of the invention.
Figure 11:
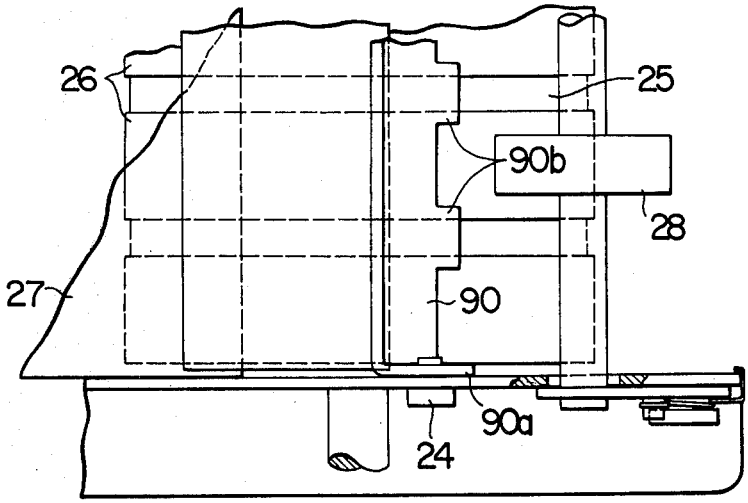
FIG. 11 is a fragmentary top view of the apparatus shown in FIG. 10.

A further embodiment is shown in FIGS. 10 to 12 where the sheet delivering revolving member comprises a rotatable cylinder 25 and a plurality of axially spaced frictional wheels 26 of an elastomeric material which are disposed on the cylinder 25 and constrained against circumferential movement. It should be noted that parts shown in FIGS. 10 to 12 which correspond to those shown in the preceding Figures are designated by like reference characters without repeating their description. Each individual projection 90*b* of the sheet separator plate 90 again bridges the space between and bears against the respective upper surfaces at their opposing lateral edges 26*a* of immediately adjacent frictional wheels 26 (see FIG. 12).

Located to the left of the revolving member is a sheet receptacle 27 which has its opposite sides secured to the sideplates 1, 2 (only one side being shown). A stack of sheets S is placed on the receptacle 27. It will be noted from FIG. 10 that the leading end portion Sb of the sheets rests on the wheels 26 and their forward edge face lies in an inclined plane in conformity to the inclination of the sheet separator plate 90.

The cylinder 25 is mounted on a shaft 25*a*, which is connected with drive means, not shown, so as to be driven for rotation in a direction indicated by an arrow *b*. A plurality of sheet guide rollers 28 are arranged to the right of the plate 90 in abutting relationship with the wheels 26 and are similarly constructed as the rollers 16 mentioned above. The wheels 26, the sheet separator plate 90, sheet S and the sheet receptacle 27 have respective coefficients of friction which diminish in the sequence named.

In operation, when the cylinder 25 is driven for rotation together with the wheels 26 in the direction of the arrow *b* shown in FIG. 10, the sheets S resting thereon tend to shift in a body in the same direction, but their movement is blocked by abutment against the plate 90. However, because of the increased coefficient of friction of the wheels 26 with the sheet, the lowermost sheet is conveyed by the wheels 26 into the nip between the projections 90*b* and the wheels 26 to be separated from the remainder of the stack. If a double sheet feeding occurs, the interrelation of the friction between the various elements acts in the same manner as mentioned previously in connection with FIG. 5, thus effectively preventing the next lowermost sheet from being fed simultaneously with the lowermost sheet.

Figure 15:
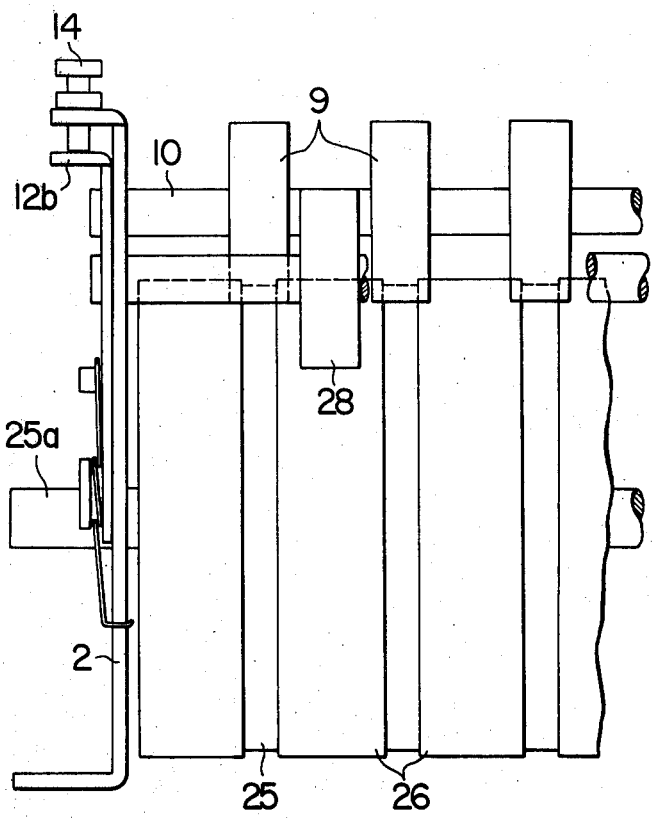
FIG. 15 is a fragmentary front view of the apparatus shown in FIG. 13.
Figure 13:
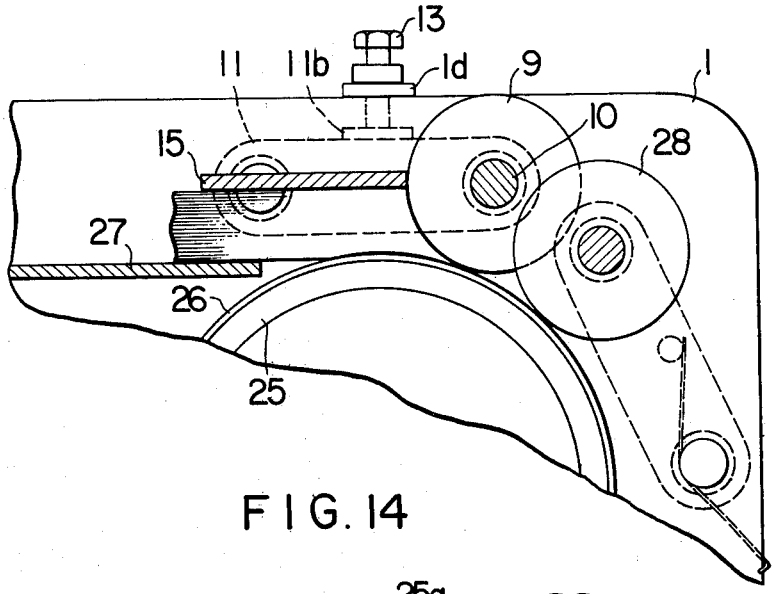
FIG. 13 is an elevational section of an additional embodiment of the sheet delivery apparatus according to the invention.
Figure 14:
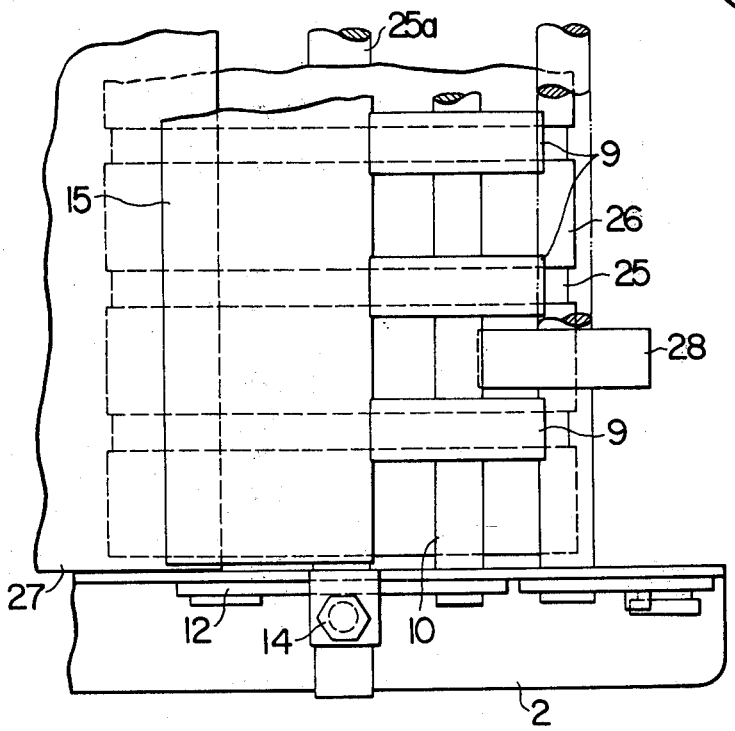
FIG. 14 is a fragmentary top view of the apparatus shown in FIG. 13.

While in the embodiment described immediately above, the sheet separator plate 90 is used to align the forward edge faces of the individual sheets in the stack along an inclined plane and to engage at their lateral edges the respective upper surfaces of the wheels, it may be replaced by the sheet separator rollers 9 mentioned above with similar effect. The resulting arrangement is illustrated in FIGS. 13 to 15, using the same reference characters, but will not be specifically described.

What is claimed is:

1. A sheet delivery apparatus comprising:

a moving, sheet delivering means, on which at least the leading end portion of a stack of sheets is placed, for delivering the lowermost sheet in said stack; said delivering means comprising a plurality of spaced, parallel-running endless belts; and a stationary, sheet separating means, disposed in abutting relationship with the moving sheet delivering means to form a nip therewith, for separating the lowermost sheet from said stack; said sheet separating means having a surface against which the forward edge faces of sheets disposed in said stack bear, said surface being inclined with respect to the sheet delivering means in a manner such that a lower sheet has its forward end advanced relative to the forward end of an upper sheet, and the separating means comprising a plurality of spaced surfaces, respectively spanning the spaces between the endless belts and bearing against the respective sheet-engaging surfaces of adjacent endless belts only at the edge portions thereof, and having a coefficient of friction with respect to the sheets in the region at the nip which is less than the coefficient of friction of the delivering means with respect to the sheets.

2. A sheet delivery apparatus as in claim 1 further comprising sheet retaining means, disposed on top of the stack of sheets and extending across its width, for urging the stack against the delivering means.

3. A sheet delivery apparatus as in claim 1 further comprising means for fixing said sheet separating means in position with respect to said delivering means.

4. A sheet delivery apparatus comprising:

a moving, sheet delivering means, on which at least the leading end portion of a stack of sheets is placed, for delivering the lowermost sheet in said stack, said delivering means comprising a rotating cylinder and a plurality of wheels of a frictional material disposed on and around said cylinder at spaced intervals from each other; and a stationary, sheet separating means, disposed in abutting relationship with the moving sheet delivering means to form a nip therewith, for separating the lowermost sheet from said stack, said sheet separating means having a surface against which the forward edge faces of sheets disposed in said stack bear, said surface being inclined with respect to the sheet delivery means in a manner such that a lower sheet has its forward end advanced relative to the forward end of an upper sheet, and the separating means comprising a plurality of spaced surfaces which respectively span the spaces between the wheels and bear against the respective sheet-engaging surfaces of adjacent wheels only at the edge portions thereof, and having a coefficient of friction with respect to the sheets in the region at the nip which is less than the coefficient of friction of the delivering means with respect to the sheets.

5. A sheet delivery apparatus as in claim 4 further comprising sheet retaining means, disposed on top of the stack of sheets and extending across its width, for urging the stack against the delivering means.

6. A sheet delivery apparatus as in claim 4 further comprising means for fixing said sheet separating means in position with respect to said delivering means.

* * * * *